United States Patent [19]

Kelly

[11] 4,000,592

[45] Jan. 4, 1977

[54] WALL SUPPORTING STRUCTURE

[76] Inventor: Thomas M. Kelly, 7551 N. Oakley, Chicago, Ill. 60645

[22] Filed: June 4, 1975

[21] Appl. No.: 583,599

[52] U.S. Cl. ..... 52/149; 52/152; 248/354 R

[51] Int. Cl.[2] ..... E04H 12/20

[58] Field of Search ..... 52/127, 146, 148, 149, 52/150, 151, 152, 749; 248/354 R

[56] References Cited

UNITED STATES PATENTS

| | | | |
|---|---|---|---|
| 251,569 | 12/1881 | Giger | 52/152 |
| 1,690,955 | 11/1928 | Stoufflet | 52/149 |
| 2,799,369 | 7/1957 | Walton | 52/152 |
| 2,887,757 | 5/1959 | Miles | 52/703 |
| 3,605,359 | 9/1971 | Bader | 52/146 |
| 3,765,543 | 10/1973 | Thomas | 52/173 |
| 3,817,006 | 6/1974 | Williams | 248/354 R |
| 3,874,625 | 4/1975 | Hansen | 52/149 |

FOREIGN PATENTS OR APPLICATIONS

| | | | |
|---|---|---|---|
| 1,232,426 | 4/1959 | France | 52/127 |

*Primary Examiner*—Price C. Faw, Jr.
*Assistant Examiner*—William Randolph
*Attorney, Agent, or Firm*—Charles F. Pigott, Jr.

[57] ABSTRACT

A device for temporarily supporting a wall in an upright position during construction of a building is provided by a first and second collapsible triangular supporting structure having a common flexible cable base extending through the thickness of the wall. The first triangular structure includes a pair of flexible cable members connected at their upper ends to wall-engaging members in proximity to the top of the wall and secured to opposite sides of the wall. The second triangular structure includes a pair of rigid tubular strut members connected to wall engaging members at a point approximately midway between the top of the wall and the base and secured to opposite sides of the wall. A pair of ground plates connected to the bottom of the struts support the first and second triangular structures on the ground.

6 Claims, 5 Drawing Figures

WALL SUPPORTING STRUCTURE

BACKGROUND OF THE INVENTION

This invention relates to a temporary supporting structure for a wall, and more particularly to a device for temporarily supporting a masonry wall in an upright position on a concrete foundation or the like during construction of a building.

During construction of a building there is a risk that a wall higher than approximately 10 feet, for example, may fall down or be blown down unless a temporary support is provided until such time as the roof is constructed for permanent support of the wall. Some building codes actually require temporary support for walls higher than 10 feet. Temporary supporting structures for a wall are particularly useful for a 16 foot to 24 foot wall.

One prior art system for temporarily bracing a masonry wall utilizes a rigid vertical cantilever beam connected to rigid diagonal braces and a horizontal strut. The principal disadvantage of the described prior art system is that it is relatively heavy, bulky, and expensive to manufacture. Furthermore, it is tedious and time-consuming to set up and take down.

Another prior art bracing system that unsuccessfully attempts to solve this problem, utilizes a series of steel cables equipment with turn buckles. The cables are placed over the wall and anchored to the ground on opposite sides of the wall so that the cable is firmly pressed against the top of the wall. Unfortunately, soil conditions often prevent adequate anchorage, and the wall will sometimes slip or sway relative to the cable.

SUMMARY OF THE INVENTION

It is an object of this invention to provide a device for temporarily supporting a masonry wall in an upright position on a concrete foundation or the like during construction of a building, which is inexpensive to manufacture, dependable in operation, and of relatively simple design and construction.

Another object of this invention to provide an improved temporary support structure for a wall that utilizes three steel cables in cooperative relationship with two rigid struts to form a relatively lightweight collapsible structure that is easily installed and removed from operating position.

A further object of the invention is to provide temporary support equipment for a wall that is light in weight, easy to handle and easy to install.

Another object is to provide in a temporary wall supporting structure supporting members which are longitudinally adjustable thus facilitating the erection of the structure.

By way of summary, the device herein disclosed provides for temporarily supporting a wall in an upright position above the ground during construction of a building by using a first and second collapsible triangular structure having a common base formed of wire rope or cable. Means operatively associated with the base are provided for supporting the structure on the ground. The first triangular structure includes wire ropes or cables operatively connected to the base member and connected at its apex to a first pair of wall-engaging members positioned on opposite sides of the wall. The second triangular structure is formed of rigid struts having their lower ends connected to the base and to the lower ends of the cables of the first triangular structure and connected at its apex to a second pair of wall-engaging members positioned on opposite sides of the wall. These structures provide a symmetrical arrangement on each side of the wall being supported.

Other objects and advantages of the invention will become more apparent when considering the following description and accompanying drawings.

DESCRIPTION OF A PREFERRED EMBODIMENT

Figure 1:
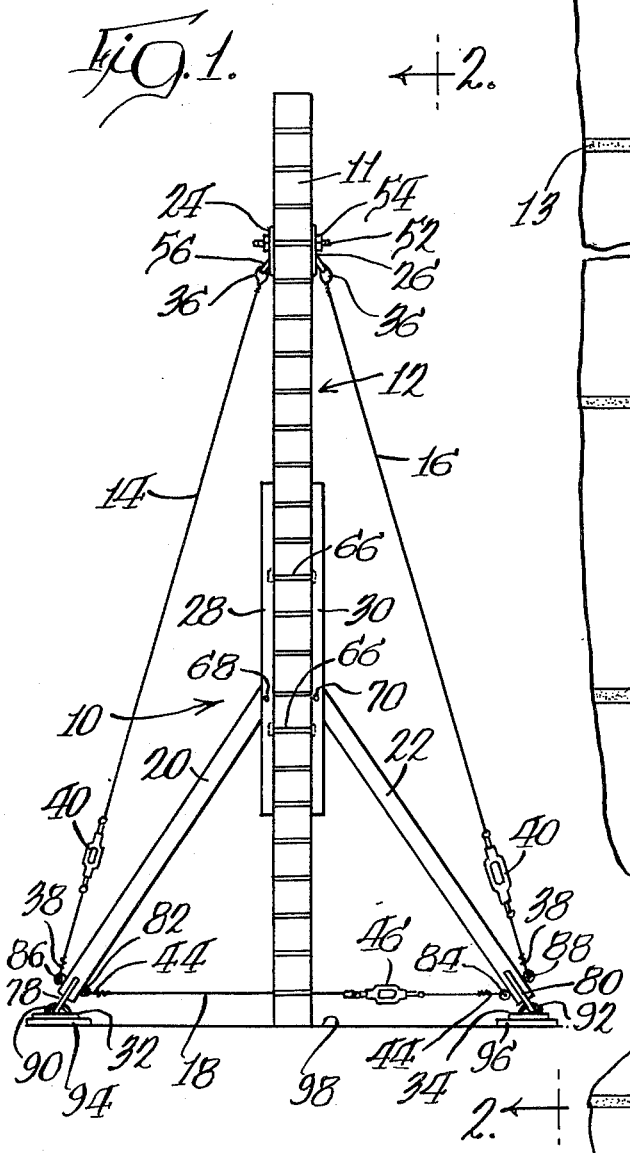
FIG. 1 is a front view of a wall supporting structure in accordance with the principles of the present invention shown in a wall supporting position.
Figure 2:
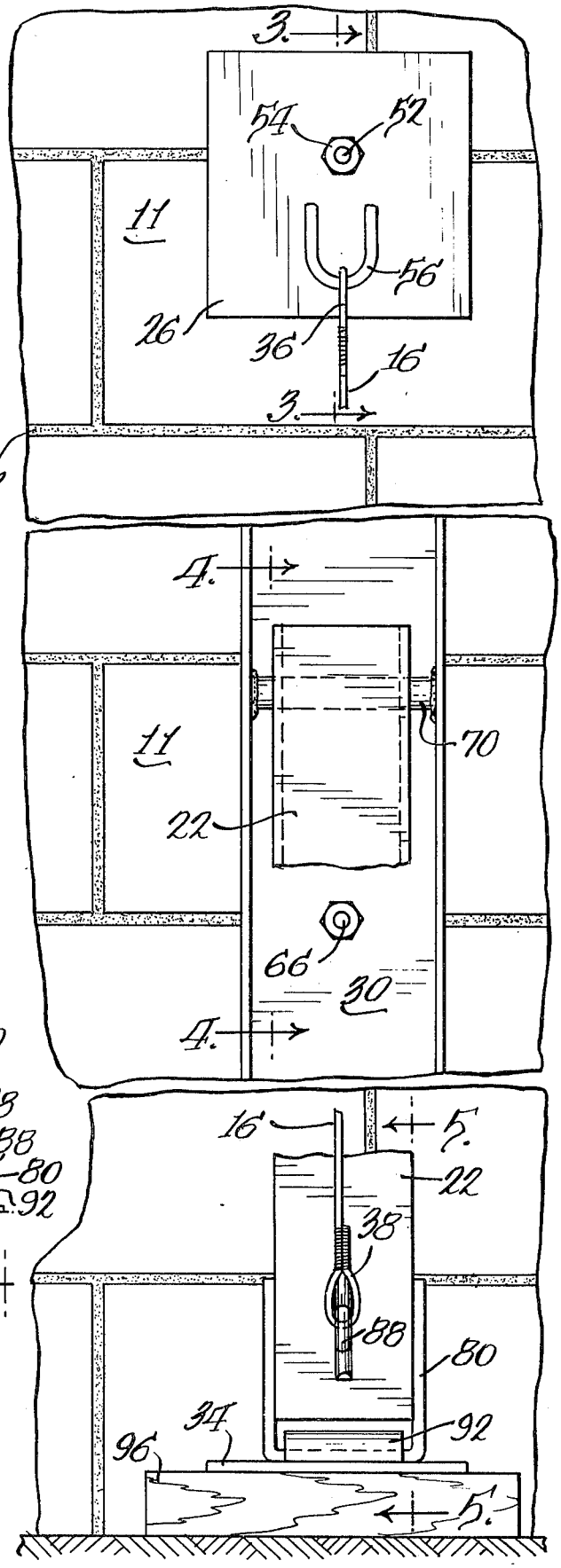
FIG. 2 is an enlarged fragmentary side view of the wall supporting structure taken substantially along line 2—2 of FIG. 1.

Referring now to the drawings wherein like reference characters in the several figures designate similar parts, FIG. 1 shows a collapsible and foldable wall supporting structure or device designated generally as 10 in position supporting a wall 12 in an upright position above the ground during construction of a building. The wall 12 may be a masonry wall made of concrete blocks 11, for example, having the usual mortar 13 therebetween. Such wall may be resting on a concrete foundation or the like as part of a building construction. The supporting structure or device 10 provides two interconnected triangular supporting structures and is symmetrically arranged on each side of the wall 12, to provide support on each side of the wall.

The device 10 comprises two flexible cable members 14 and 16 disposed on opposite sides of the wall 12, a third flexible cable base member 18 and two rigid strut members 20 and 22 disposed on each side of the wall. The structure 10 also includes a first pair of wall engaging members 24 and 26 attached to and disposed on opposite sides of the wall 12. The structure 10 further includes a second pair of wall engaging members 28 and 30 also attached to and disposed on opposite sides of the wall 12. The members 24 and 26 are attached at the upper portion of the wall and the members 28 and 30 are attached at a point substantially midway between the upper members 24 and 26 and the ground or foundation upon which the wall 12 rests. The structure 10 also includes a pair of base plate members 32 and 34 disposed on opposite sides of the wall 12 which rest upon the ground and to which the lower ends of the strut members are connected.

Generally speaking, in the erected structure, that is, when the device of the invention is rigged in its supporting position, the upper ends of the flexible cable members 14 and 16 are attached to the upper wall engaging members 24 and 26 and the flexible cable base member 18 is disposed generally horizontally extending through an opening in the wall and connected between the lower ends of the strut members 20 and 22. The strut members 20 and 22 have their lower ends secured to the base plate members 32 and 34 in a swiveled or pivotal relationship. The two base plate members 32 and 34 are positioned on the ground on opposite sides of the wall and substantially equidistantly from the wall. The upper ends of the strut members 20 and 22 are propped against opposite sides of the wall 12 against the wall engaging members 28 and 30 at an angle of approximately 45° with the horizontal.

The flexible cables 14, 16 and 18 which preferably are formed of wire rope or flexible multi-stranded steel cable may be approximately ½ inch to ¾ inch in diameter. The cables 14 and 16 may have loops 36 formed at their upper ends for securing to the wall engaging members 24 and 26 respectively. Similar loop portions 38 may be formed at the lower ends of the cables 14 and 16 for attachment to the strut members 20 and 22. Each of the cables 14 and 16 is provided with a length adjustment means preferably in the form of a turn buckle 40 interposed intermediate the ends thereof so that each cable is essentially in two sections, the turn buckle serving to tighten or slacken the cable as needed and for reasons which will hereinafter become more apparent.

The flexible cable base member 18 likewise may have loop portions formed at each end thereof for attachment to the lower end of the strut members 20 and 22 respectively. A turn buckle 46 also is interposed intermediate the ends of the cable 18 also for purposes of tightening or slackening the cable to adjust its length. It will be observed from FIG. 1 that the cable base member 18 forms a common base for the two triangular structures consisting in one case of cables 14, 16 and 18 and in a second case of struts 20 and 22 and cable 18.

Figure 3:
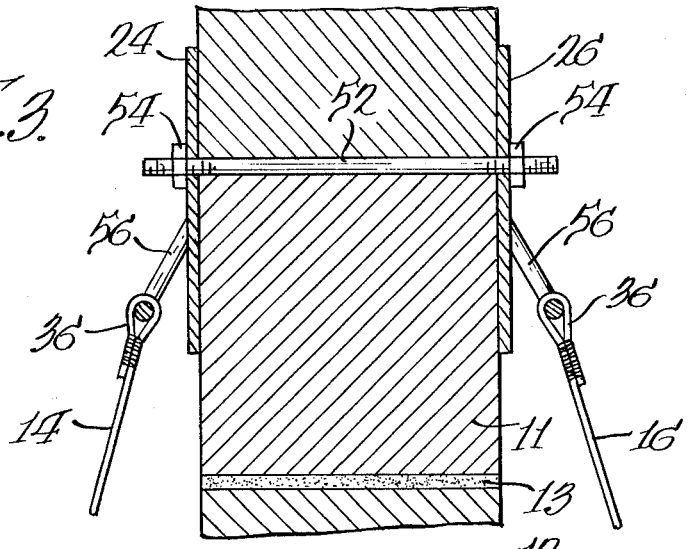
FIG. 3 is a cross-sectional view taken substantially along line 3—3 of FIG. 2 and showing a first pair of wall-engaging members connected to flexible cable members.

The first pair of wall engaging members 24 and 26 may each comprise a rectangular plate 48 and 50 preferably of metal which are secured to the opposing faces of the wall 12 by a threaded bolt 52 extending through the wall and nuts 54 threaded on each end of the bolt 52. Each of the rectangular plates 48 and 50 may be approximately 8 inches × 8 inches × ¼ inch and may have welded thereto a U-shaped loop or anchor 56 to which the upper ends of the cables 14 and 16 are attached. The loop preferably is positioned on the plate at an angle of about 30° with the plate. While the upper ends of the cables 14 and 16 are here shown as in FIG. 3, for example, with permanent loops formed in the end thereof for attachment to the anchors 56, it will be appreciated than an easily removable shackle may join the upper ends of the cables 14 and 16 to the anchoring loops 56 thus making the cables easily detachable from the wall engaging members.

The second pair of wall engaging members 28 and 30 preferably are U-shaped channel members of approximately 6 feet in length, approximately 6 inches in width and approximately two and one half inches in depth. In a wall supporting position the U-shaped channel members 58 and 60 are disposed in a substantially vertical position on opposite sides of the wall 12 thus spreading the supporting thrust over a substantial area. The channel member 58 is formed with outwardly extending flanges 62 and 63 and the channel member 60 is formed with outwardly extending flanges 64 and 65. A plurality of bolts 66 which may be threaded on each end to receive nuts thereon may be used to secure the channel members to the wall 12, the bolts 66 extending through the wall 12. Pins or rods 68 and 70 preferably of about one inch in diameter are secured between opposing flange members on each of the U-shaped channels for receiving the upper ends of the strut members 20 and 22 by way of slots 72 and 74 formed in the upper ends of the strut members.

Other wall engaging means besides the U-shaped channel members could be used. For example, a flat plate having an opening therein for engaging a cooperating notched portion on the end of the strut members could be used. In addition, a flat plate instead of the U-shaped channel irons could be used. A U-shaped bar could be welded to the flat plate wherein the cross-bar portion of the U-shaped bar would be received in slots in the end of the struts like the slots 72 and 74 illustrated in FIG. 4.

The struts or beams 20 and 22 may each be formed as rigid tubular metal members of equal length. Besides having formed at their upper ends the slot for receiving the rod 68 or 70, the upper end of the strut is formed with a beveled end 76 for contacting the base of the U-shaped channel member so that the strut exerts a force not only against the rod 68 or 70 but also against the base of the U-shaped channel member.

The bottom ends of each of the struts 20 and 22 may have rigidly secured thereto a U-shaped metal anchoring loop or hinge 78 and 80 respectively for attachment to the base plate members 32 and 34. The anchoring loops may be constructed of ¾ inch diameter rod material. The lower end of the struts 20 and 22 also have formed at the lower ends thereof inwardly positioned metal straps or loops 82 and 84 and outwardly positioned metal loops 86 and 88. The loops 82 and 84 are adapted to have attached thereto the ends of the cable base member 18. The loop 86 has attached to it the lower end of cable 14 and the loop 88 has attached to it the lower end of cable 16. It will be appreciated that the lower ends of the cables 14 and 16 may be attached to the metal loops on the struts by releasable shackle members.

Each of the base plate members 32 and 34 may comprise a substantially square steel plate of approximately 8 inches square and having formed at the center thereof metal loops or straps 90 and 92 for pivotally attaching thereto respectively the lower ends of the struts 20 and 22 by means of the anchoring loops 78 and 80. When the device 10 is erected, a pair or wooden supports 94 and 96 of a larger area may be provided to seat thereon respectively the base plate members 32 and 34. The larger size of the wooden supports 94 and 96, of course, permits spreading the load over a larger area on the ground 98.

Erecting wall supporting structure 10 is relatively simple. Wall 12 is built upwards on a conventional foundation (not shown). As the wall is being constructed, mortar is dug out of the wall 12 near the wall bottom and across its entire thickness to provide an opening for receiving therethrough flexible cable base member 18. When the wall reaches approximately 10 feet in height, second and third openings are similarly dug out of mortar for receiving bolts 66. The second pair of wall engaging members 28 and 30 then are secured against wall 12 between points 4 feet and 10 feet above the ground assuming 6 foot channels are used with bolts 66. Thus the horizontal strut receiving rods 70 would be approximately 6 feet above the ground.

Figure 4:
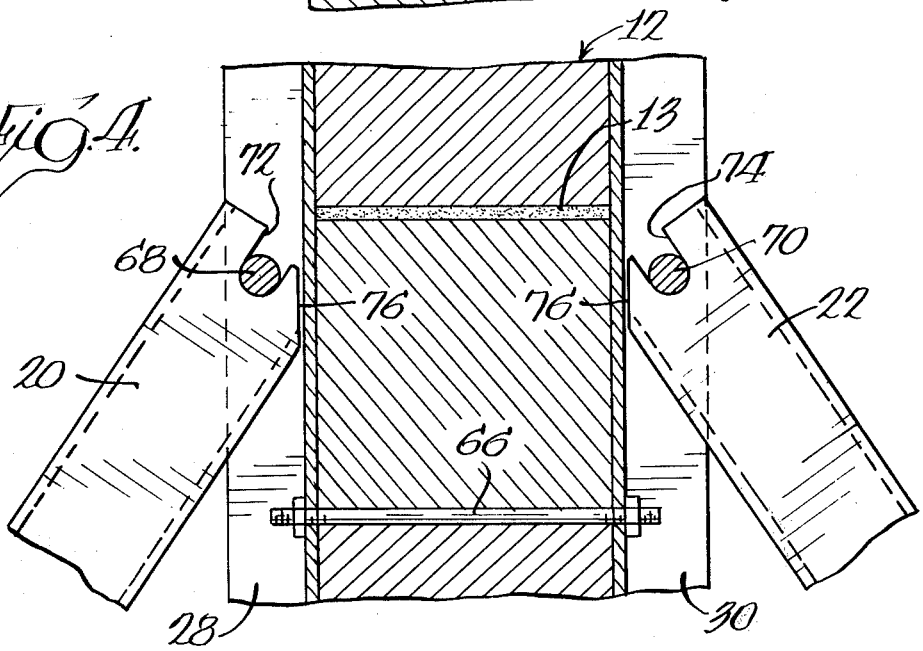
FIG. 4 is a cross-sectional view taken substantially along line 4—4 of FIG. 2 and illustrating a pair of rigid struts in a wall supporting position and removably engaging a second pair of wall-engaging members.
Figure 5:
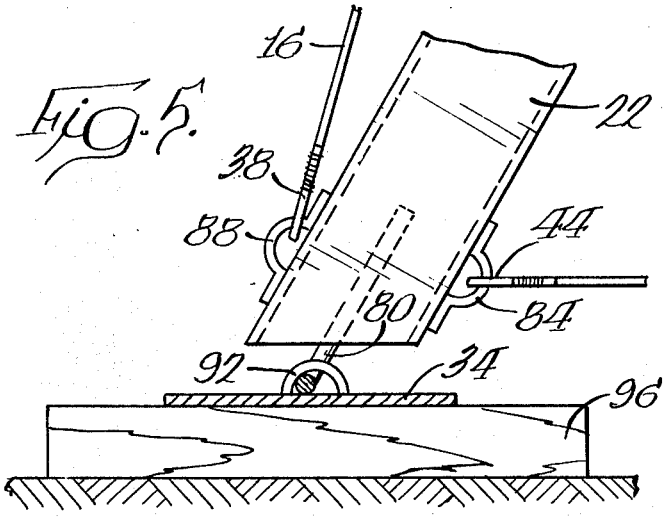
FIG. 5 is a cross-sectional view taken substantially along line 5—5 of FIG. 2 and showing a rigid strut connected to a base plate.

When wall 12 reaches at least 12 feet in height, another opening is dug out of mortar 13 across the wall thickness for receiving the bolt 52 so as to position the first pair of wall engaging members 24 and 26 approximately 2 feet below the top of wall 12. The first pair of wall engaging members 24 and 26 are then secured to wall 12 by the bolt 52 and the open slots 72 and 74 of struts 20 and 22 are placed against horizontal strut-receiving rods 68 and 70 as shown in FIG. 4. If the cable 18 is in two sections with a section permanently attached to the lower ends of the struts 20 and 22, the lefthand detachable segment of flexible base member 18 is pushed through the bottommost opening formed in the wall and connected to the turnbuckle 46 of right-hand portion of flexible base member 104. The cable 18, of course, may be arranged to be detachably connectible at each end to the loops 82 and 84 on the lower ends of the struts.

The base plate members 32 and 34 and their associated wooden supports, as previously described, are then moved equidistantly outward from the wall as shown in FIG. 1 to anchor wall supporting structure 10. Turn buckles 40 and 46 are then adjusted to tighten flexible cable members 14 and 16 and flexible base member 18, respectively, thus forming a structure 10 for temporarily supporting the wall 12. In the supporting position the cables 14, 16 and 18 are in tension and the strut members 20 and 22 are in compression. When wall 12 is sufficiently permanently supported and braced by a roof (not shown), wall supporting structure 10 is disassembled in the reverse order of the procedure described above and the openings in wall 12 are filled with additional mortar 13.

It will be apparent that I have advantageously provided a temporary wall supporting structure which is simple in design and easy to manufacture. Furthermore, the device is light and easily transportable. In addition, it is easy to install and easy to remove.

While a preferred embodiment of the invention has been disclosed, it will be appreciated that this has been shown by way of example only, and the invention is not to be limited thereto as other variations will be apparent to those skilled in the art and the invention is to be given its fullest possible interpretation within the terms of the following claims.

I claim:

1. A temporary wall supporting device for supporting a wall in an upright position above the ground, comprising:

a pair of ground anchoring means disposed on opposite sides of the wall;

upper and lower pairs of wall-engaging members secured on opposite sides of the wall;

first and second collapsible triangular structures having a common base member extending through an opening in the wall adjacent its lower end;

said first triangular structure further including a pair of rigid strut members having their lower ends connected to said pair of ground anchoring means and their upper ends connected to one of said pairs of wall-engaging members; and said second triangular structure further including a pair of longitudinally flexible members under tension having their upper ends connected to the other of said pairs of said wall-engaging members and having their lower ends connected to the lower end of said rigid strut members.

2. The combination of claim 1, further comprising first and second fastening means for detachably interconnecting, respectively, said upper and lower wall-engaging members through openings provided in said wall.

3. The combination of claim 2, wherein said upper pair of wall-engaging members comprises a pair of plates disposed on each side of said wall and said first fastening means comprises a bolt extending through said opening formed in said wall and threadedly fastened at its ends to said pair of plates.

4. The combination of claim 1, wherein said lower pair of wall-engaging members comprises a pair of elongated channel members, each of which include means for removably connecting the upper ends of said strut members thereto.

5. The combination of claim 4, wherein said connecting means includes a rod portion extending outwardly of said channel members and wherein said upper end of said strut members is formed with a recess for receiving said rod portions.

6. A temporary wall supporting device for supporting a wall in an upright position above the ground, comprising:

a pair of ground anchoring means disposed on opposite sides of the wall;

upper and lower pairs of wall-engaging members secured on opposite sides of the wall, each of said upper wall-engaging members having a transversely extending loop portion;

first and second collapsible triangular structures having a common cable base member extending through an opening in the wall adjacent its lower end;

said first triangular structure further including a pair of rigid strut members having their lower ends pivotally connected to said pair of ground anchoring means and their upper ends connected to said lower pairs of said wall-engaging members; and said second triangular structure further including a pair of longitudinally adjustable cable members under tension having their upper ends hooked onto said loop portion of said upper wall-engaging members and their lower ends hooked onto a loop portion formed on the lower end of said rigid strut member.

* * * * *